United States Patent [19]

Gugliotta et al.

[11] 4,211,044

[45] Jul. 8, 1980

[54] TUBE SPACE FRAME SYSTEM

[76] Inventors: Paul F. Gugliotta, 39 E. 20th St., New York, N.Y. 10003; David Hoffmann, 117 Jefferson St., Milwaukee, Wis.

[21] Appl. No.: 928,942

[22] Filed: Jul. 28, 1978

[51] Int. Cl.[2] ..... E04B 7/18

[52] U.S. Cl. ..... 52/200; 52/650

[58] Field of Search ..... 52/200, 648, 650; 403/171, 176

[56] References Cited

U.S. PATENT DOCUMENTS

| | | | |
|---|---|---|---|
| 2,284,898 | 1/1942 | Hartman | 52/648 |
| 3,421,280 | 1/1969 | Attwood et al. | 52/648 |
| 3,466,824 | 9/1969 | Troutner | 52/648 X |
| 3,861,107 | 5/1973 | Papayoti | 52/650 |
| 3,882,650 | 5/1975 | Gugliotta | 52/648 X |
| 3,914,063 | 10/1975 | Papayoti | 52/650 X |
| 4,070,847 | 1/1978 | Madl | 52/650 |

FOREIGN PATENT DOCUMENTS

| | | | |
|---|---|---|---|
| 829442 | 3/1960 | United Kingdom | 52/200 |

*Primary Examiner*—Ernest R. Purser

*Attorney, Agent, or Firm*—Hubbell, Cohen, Stiefel & Gross

[57] ABSTRACT

A space frame system built from rectangular tubing comprisingtwo substantially parallel planar chord frames laced together by many diagonal struts. The planar frames are of a rectangular grid pattern, both of the same grid dimensions, each made from continuous chords in one direction and tie chords one grid dimension long in the other direction, all the chords being disposed in one plane without overlap. Each frame has a position aligned with but out of registration with the other by half a grid dimension each way so intersections on one planar frame line up with open centers of the grids on the other. Diagonal struts run from intersections on one planar frame to the nearest intersections on the other. At intersections, the chords and struts are bolted or welded to one or more flat and bent plates. The outermost surfaces of the chords in one planar frame may be left clear of bolts and plates, and skylights may be mounted thereon.

21 Claims, 20 Drawing Figures

TUBE SPACE FRAME SYSTEM

BACKGROUND OF THE INVENTION

1. Field of the Invention

The present invention relates to space frame systems of the type in which two substantially parallel rectangular grid frames are interconnected by a plurality of diagonal struts.

2. Description of the Prior Art

Space frames are well known in the art, such as the type in which a pair of rectangular grid frames are offset one from the other by half a grid dimension in both directions and diagonal struts run from every grid intersection to the four nearest grid intersections on the opposing frame. Such a geometrical arrangement is disclosed in R. B. Hartmen, U.S. Pat. No. 2,284,898; in C. W. Attwood et al, U.S. Pat. No. 3,821,280; in A. L. Troutner, U.S. Pat. No. 3,466,824; and in H. V. Papayoti, U.S. Pat. No. 3,914,063, and a double thickness three frame arrangement of the same type is shown in H. V. Papayoti, U.S. Pat. No. 3,821,107.

All of these patents excepting Troutner disclose use of generally "U" section chords and struts, which are attached by bolts passing through the bottom of the "U". While this design provides ease of assembly, it has a problem in that it only makes use of a single shear resistance of the bolt. That is, the bolt only has to fail in shear in the single plane between the two bolted-together members in order for the joint to slide apart. Twice the strength in shear is available by use of three-layer designs, the center layer pulled one way and the two outer layers the other, so that the bolt must be sheared apart in two planes to part the joint.

A second and a third problem also come from this one-sided attachment, the second being that it imposes an undesirable bending moment on whatever the member is bolted to, equal to the tensile or compressive force carried by the member times the eccentricity between the attachment plane and the axis of the force. The third problem is that it reduces the maximum force in compression that the member can safely carry. It is usual to design to avoid the failure mode in which the straight member under compression becomes unstable and collapses into a curve, a collapse by either elastic or plastic buckling, and it can be seen that the previously described momemt from the eccentricity starts this off, predisposes this type of curving, and so reduces the safe load.

Troutner discloses "U" chords, but avoids the three problems above with the struts by using for them round tubes, which each end flattened to the center (not eccentric) and bolted in position as the center layer of three layers, in double shear.

Papayoti, in U.S. Pat. No. 3,914,063, discloses use of pairs of "U" section chords or struts, on either side of the connecting member back-to-back at the bottoms of the "U" sections, whereby as to each single member of the pair, all three problems remain, but as to the two members together, there is double shear, and the two bending moments on the joint offset one another. Problem three, the reduced allowable compressive force in elastic or plastic buckling modes, is still a problem, for each member of the pair, and there is no way for this to be compensated or cancelled out.

A fourth problem is that when a "U" section member is placed in compression, the unsupported sides of the "U" may buckle sideways elastically or by plastic deformation, in yet another mode of collapse. Again, Trautner also avoids this problem, at least as to the struts, by using round tubes. Papayoti, in U.S. Pat. No. 3,914,063 discloses a "U" section member with the free edges folded over double, which partially compensates for the lack of support of the sides of the "U".

A fifth problem is the inevitable weakening caused by having a joint in each chord at each grid intersection, as disclosed by all of these patents excepting Hartman. If continuous chords are used and overlapped at grid intersections, as disclosed in Hartman, this problem is avoided, but the chords then no longer lie in a single plane. Eccentricity problems are created by not having all of the chord forces in one plane, not unlike those described for single members previously, with now three instead of two dimensions. Further, if the chords are overlapped, there is more height required for the space frame. It becomes more difficult to mount additional structures, such as skylights, on the uneven overlapped structure. And it becomes more difficult to "stack" one space frame on another, as disclosed, for example, in Papayoti, U.S. Pat. No. 3,821,107.

Many of these problems are reduced or eliminated if all of the members are closed tubes. However, closed tubes are more difficult to interconnect than "U" sections, and particularly so for round sections. Moreover, it is somewhat more difficult to arrange mounting of skylights and other structures upon round section space frame systems. Gugliotta, U.S. Pat. No. 3,882,650 discloses a pipe-and-ball truss array including an interconnection system. There each pipe member is held against connector balls at each of its ends by an internal coaxial rod threaded at the rod ends, extending just beyond the pipe ends through holes in the ball walls, and secured by nuts within. Earlier designs, such as disclosed in British Pat. No. 1,206,399, have threaded pipe ends screwed into corresponding threaded holes in the balls, or have welded the pipe ends to the balls. These systems all tend to be costly.

SUMMARY OF THE INVENTION

A space frame system is provided which comprises chords and struts which are lengths of rectangular section hollow tubing, and means for interconnecting these chords and struts, the chords being disposed in two planar frames and the struts laced diagonally between the frames to hold them apart and substantially parallel. The planar frames are of a rectangular grid pattern, both of the same grid dimensions, each made from continuous chords in one direction and tie chords one grid dimension long in the other direction, all the chords being disposed in one plane without overlap. Each frame has a position aligned with but out of registration with the other by half a grid dimension each way so intersections on one planar frame line up with open centers of the grids on the other. Diagonal struts run from intersections on one planar frame to the nearest intersections on the other. At intersections the chords and struts are bolted or welded to one or more flat and bent plates.

Some applications may favor use of a rectangular grid, but the more usual grid pattern is square. The direction of the continuous chords, in either of these cases, rectangular or square, may either run the same in both chord frames, or run at right angles, so long as suitable interconnection is provided.

The diagonal struts are made of square tubing, all of the same external width. The wall thickness may be increased inwards for some of the struts for which extra strength is required. Most usually the chords are square, not necessarily of the same size as the struts, but they may be modified to accommodate strength, rigidity or mounting requirements, as, for example, when skylights or other structures are to be mounted. Thus, chords may have heavier wall thickness, or may be rectangular, and if rectangular may be turned either way. All chords will in the usual case have the same external dimension measured normal to the frame.

Connector plates may be bent from a flat plate, one simple version dividing the plate into three regions by two parallel bend lines: a left flap, a center section still lying in the original plane, and a right flap, bent towards the same direction from the original plane as was the left flap. The chords are attached onto the center section on the side away from the flaps, and the bend angle of the flaps is chosen so that two strut ends will be lined up alongside and may be attached to each of the two flaps, thereby interconnecting at one point a continuous chord, two tie chords, and four diagonal struts. A variation would be to bend down each corner of a square plate to provide attachment tabs for four struts. This connector plate design is open on the tab side and would permit a second set of chords, one set then attached on either side of the connector plate, should a second set be required.

Each attachment may be made by a nut and bolt, passing the bolt in turn through the tube (both side walls) and the plate. For reinforcement, another plate can be included on the other side of the tube from the connector plate, held by the same bolt. If on the chords, on the side away from the connector plate, it is flat and called a tie plate. If on the struts, on the side away from the connector plate, it is bent to fit and called a backup plate. One or both reinforcement plates may be used, or neither.

For attachment of struts or tie chords to the connector plate, where no reinforcing plate is being used on the other side of the tube, it is not necessary for the bolt to be run through both sides of the tube. Since there is, for struts and tie chords, an open end adjacent, that open end of the tube can be used for access to insert the bolt into a one-wall bolted attachment, passing through the one side wall which bears against the plate, passing through the connector plate, and being secured by a nut. This bolt may be tack welded in place to the tube at the factory, cutting down on the number of loose parts on site, and holding the bolt while the nut is tightened.

A one-wall bolted attachment of a continuous chord along its length and distant from an open end requires an access hole in the chord side wall opposite the attachment location, large enough to pass the bolt head. If internal drive bolts are used, such as Allen head bolts, the access hole will also be large enough to pass a suitable tool for tightening the bolt. An alternate method would be welding.

Preassembly and welding of some of the attachments may be carried out in the factory under optimum conditions, in order to cut down on the number of loose parts on site, simplify field erection, improve strength, and meet other requirements such as keeping some tube side walls free and clear of bolt heads or other projections. For example, the continuous chords might be shipped to the site with tie plates and connector plates already welded in position. Field welding is available as an option, but is preferably avoided for reasons of cost and quality control.

An alternate bolting attachment of struts to connector plate is by a bite configuration in which the end of each strut tube is slotted and pushed over the edge of the connector plate above and below, bolting through the tube side wall above, through the connector plate, and through the second tube side wall below, to the securing nut. This bite configuration provides an attachment aligned with the force axis of the strut and so avoids the weakening effects of eccentricity, just as would the use of a backup plate as described earlier. Moreover, in common with that two-plate mounting, it loads the bolt in two shear planes, double shear for greater strength. Slotted-end diagonal struts may be of either square or round section, the two being interchangeable.

Where skylights or additional structures are to be mounted onto some or all of the chords, the mounting surfaces may be provided on those chords by not using tie plates, and by use of welding or of one-wall bolted attachments of those chords which need to have mounting surfaces free and clear.

Skylights may be configured to cover one grid each, or long arched skylights might be mounted which bridge from one continuous chord to the next. In either case, conventional sealing mountings would be made along the free and clear outer side walls of the supporting chords.

DETAILED DESCRIPTION OF THE PREFERRED EMBODIMENTS

Figure 1:
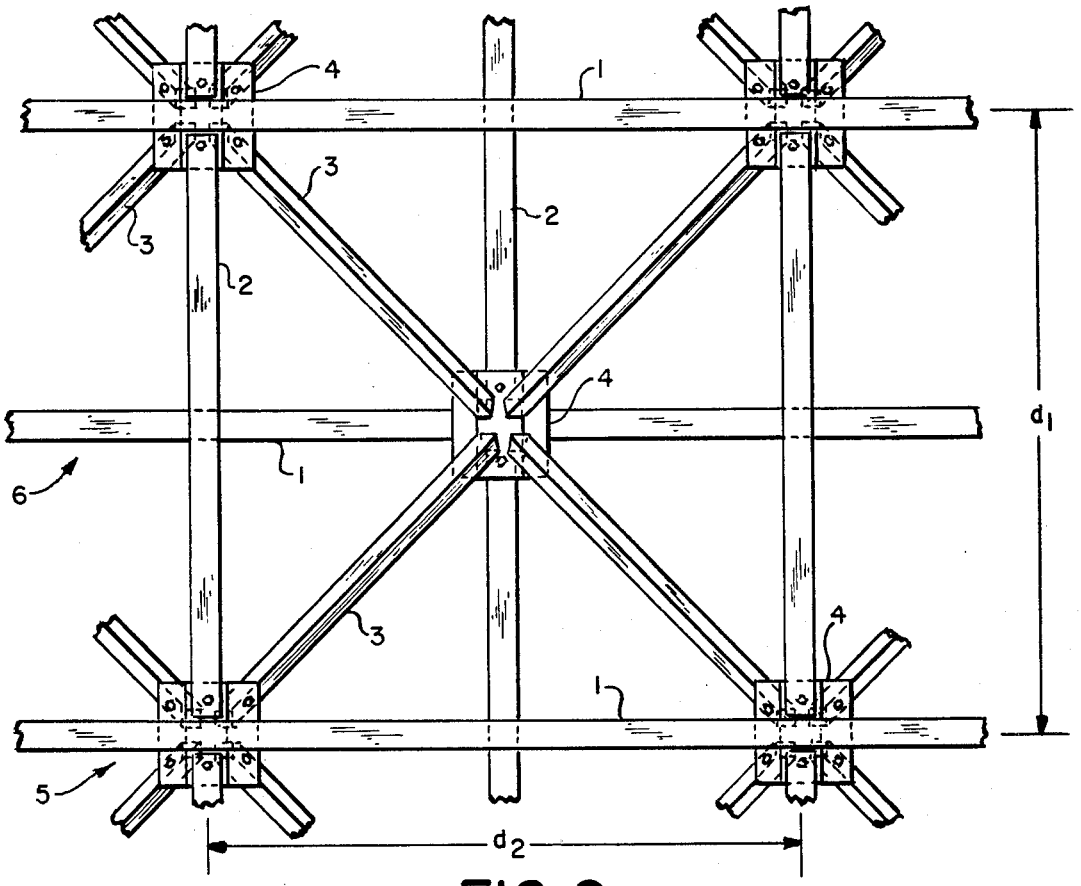
FIG. 1 is a fragmentary plan view of a preferred space frame system showing one grid of a near frame with four diagonal struts running to an intersection of the substantially parallel frame behind it.
Figure 2:
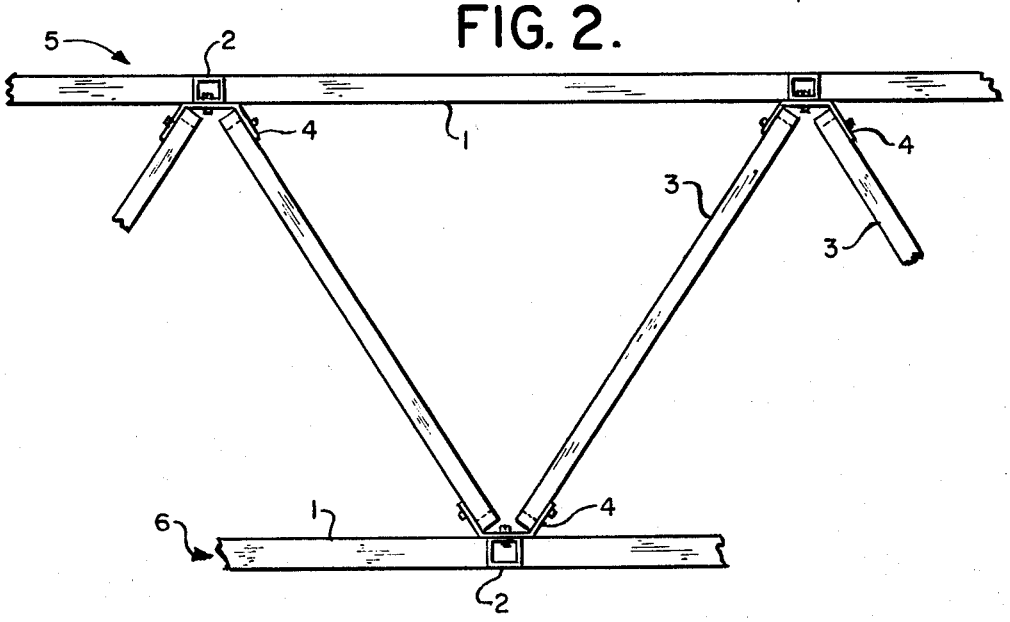
FIG. 2 is a fragmentary side elevation of the space frame system shown in FIG. 1.

Referring now to the drawings in detail and initially to FIGS. 1 and 2, parallel chord frames 5 above and 6 below are shown linked in a typical space frame by diagonal struts 3. The rectangular dimensions $d_1$ and $d_2$ of the one grid shown of frame 5 are equal, the preferred design. The continuous chords 1 in both frames run left to right, and the tie chords 2 at right angles, in the direction of dimension $d_1$. One intersection of frame 6 appears, below the center of the grid shown of frame 5. Diagonal struts 3 run from each intersection on one frame to the four nearest intersections on the parallel frame. The chords 1 and 2 and struts 3 are joined by attachment to a connector plate 4 provided at each intersection.

Figure 3:
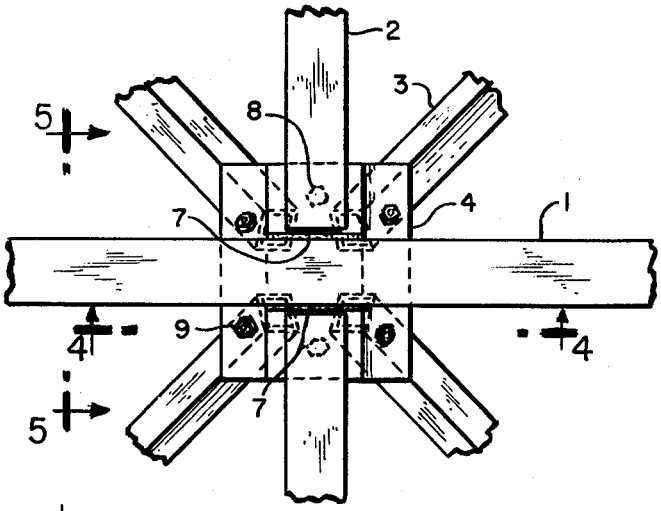
FIG. 3 is a fragmentary plan view showing one intersection of the space frame system shown in FIG. 1.
Figure 4:
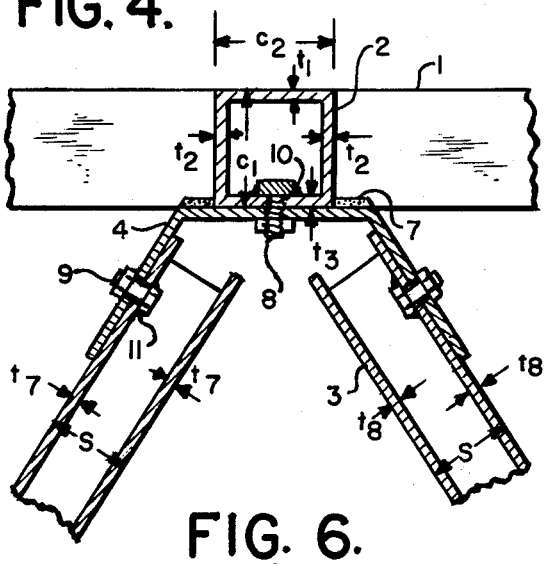
FIG. 4 is a fragmentary section from one side of the intersection shown in FIG. 3.
Figure 5:
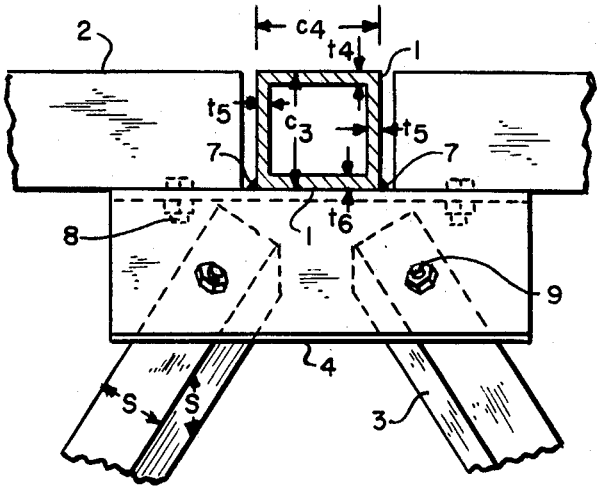
FIG. 5 is a fragmentary section from a second side of the intersection shown in FIG. 3.

A preferred arrangement of such an intersection is shown in FIGS. 3, 4 and 5. The preferred connector plate 4 is shown, formed from a flat plate by two parallel bends. The continuous chord 1 is attached to plate 4 by two welds 7. The tie chords 2 are bolted through the side wall that bears against the connector plate 4 for attachment to the connector plate 4. The nut and bolt collectively are designated 8. The bolt part of 8 is tack welded to the side wall of tie chord 2 by weld 10. Similarly, nut and bolt 9 secure each diagonal strut 3 to connector plate 4, with tack weld 11 holding the bolt in place permanently.

Still considering FIGS. 3, 4 and 5, in this embodiment, the top surfaces of the chords have been left free and clear of projections or obstructions, which simplifies mounting roofs, skylights, additional space frame layers, or other structures. For the same and other reasons, the height $C_1$ of tie chord 2 is preferably the same as the height $C_3$ of continuous chord 1. In most designs, absent special strength or mounting requirements, all chords would be square and of the same wall thicknesses, $C_1=C_2=C_3=C_4$ and $t_1=t_2=t_3=t_4=t_5=t_6$. However, rectangular proportions with either side down, and variation in wall thickness between tie chords and continuous chords, or within one type from side wall to side wall, may be accommodated, to add strength, rigidity, or other required characteristics in a selective fashion, where needed. Diagonal struts 3 are intended to be loaded primarily in tension and compression applied axially, or nearly so. Consequently, each strut will be square and have a uniform wall thickness. The width S of the struts will preferably be constant in any one space frame, but the wall thickness $t_7$ of one strut may be greater or less than that $t_8$ of some other strut, depending upon the design loads for each.

Figure 6:
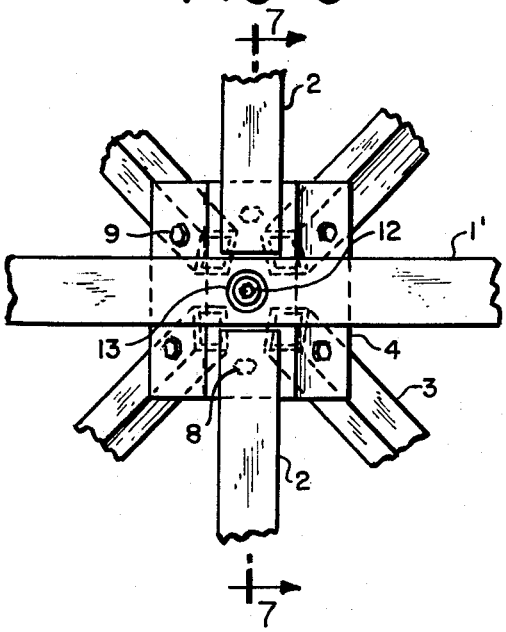
FIG. 6 is a fragmentary plan view showing one intersection of a space frame, in which the continuous chord is attached to the connector plate by an internal-drive-head type of bolt inserted through an access hole.
Figure 7:
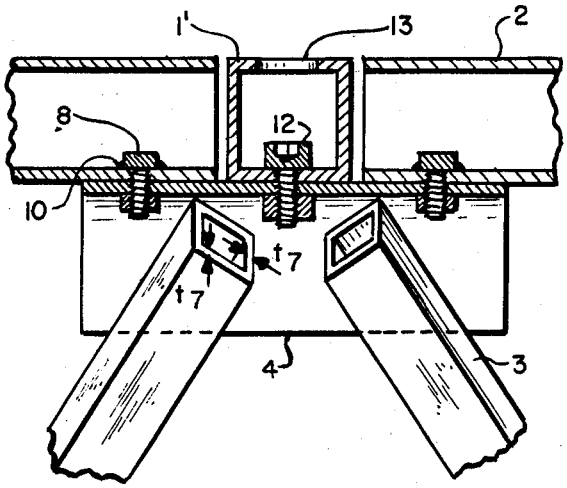
FIG. 7 is a fragmentary section through the center of the intersection shown in FIG. 6.

FIGS. 6 and 7 depict an intersection structure similar to that of FIGS. 1–5, excepting that the continuous strut 1′ is not attached to connector plate 4 by welds 7, but rather by nut and bolt set 12, in which the head of the bolt is of internal drive design, for example an Allen Head bolt. An access aperture 13 larger than the bolt head is provided in the sidewall directly opposite the bolt location for insertion of the bolt, and for passage of a tool to tighten the bolt.

Figure 8:
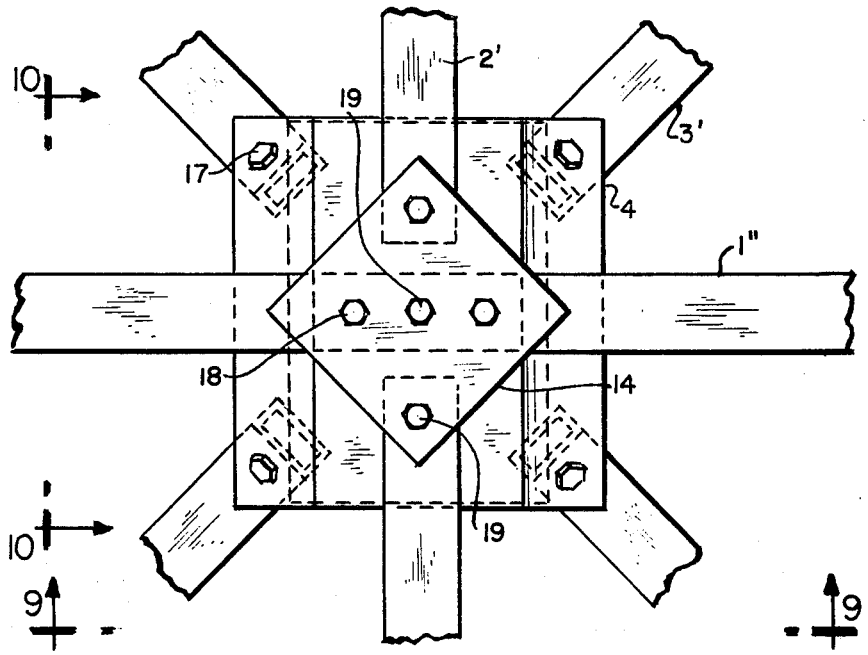
FIG. 8 is a fragmentary plan view showing one intersection with a reinforcing square tie plate above the chords and a reinforcing backup plate below the struts.
Figure 9:
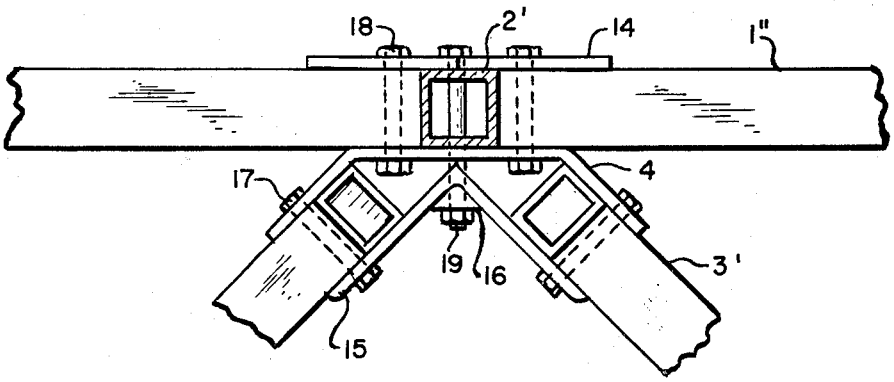
FIG. 9 is a fragmentary section from one side of the intersection shown in FIG. 8.
Figure 10:
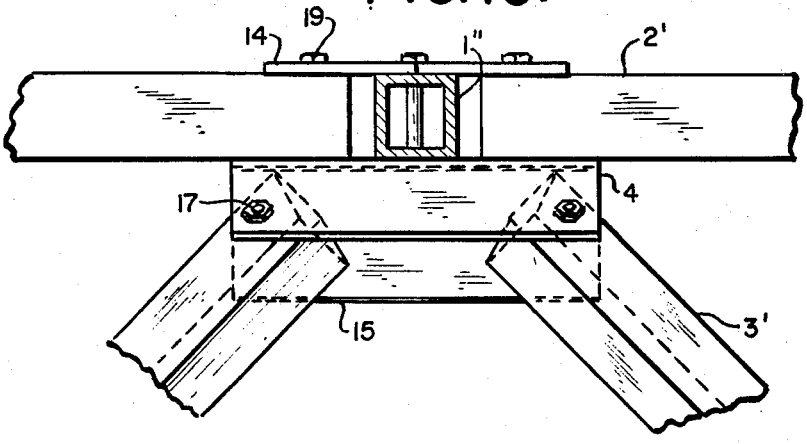
FIG. 10 is a fragmentary section from a second side of the intersection shown in FIG. 8.

Now referring to FIGS. 8, 9 and 10, reinforcing plates may be provided contacting and supporting each chord or strut on the side wall opposite the side wall borne against by the connector plate, with the bolted attachment in each case sandwiching the chord or strut between two plates. Thus, a flat square tie plate 14 is above the chords, continuous chord 1″ being held between plate 14 and connector plate 4 by nut and bolt sets 18. Similarly, nut and bolt sets 17 hold diagonal struts 3′ between connector plate 4 and a bent backup plate 15 beneath. Three additional nut and bolt sets 19 are used as well, which run through the plate 14, chords 1″ or 2′, connector plate 4, backup plate 15, and wedge-shaped transition spacer washers 16, necessary to provide flat seats for the nuts of sets 19. This construction with two plates about each chord or strut employs each bolt in double shear, for double strength from one bolt compared to single shear. Additionally, it eliminates eccentricity in loading each strut or chord axially, which increases strength in the structure, particularly for compressive loading. Further, overall rigidity is increased, at each intersection. However, the top surface is no longer clear and free of obstructions and costs are increased by the added structure.

Figure 11:
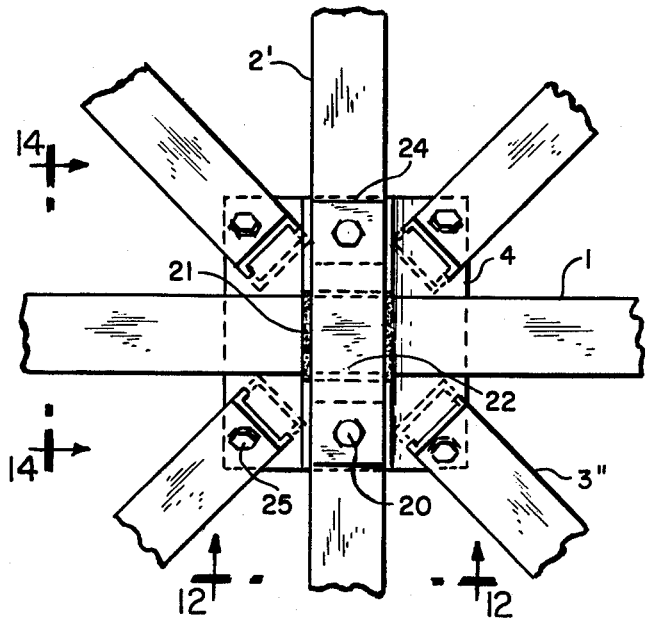
FIG. 11 is a fragmentary plan view showing one intersection with a rectangular tie plate and end slotted diagonal struts.
Figure 12:
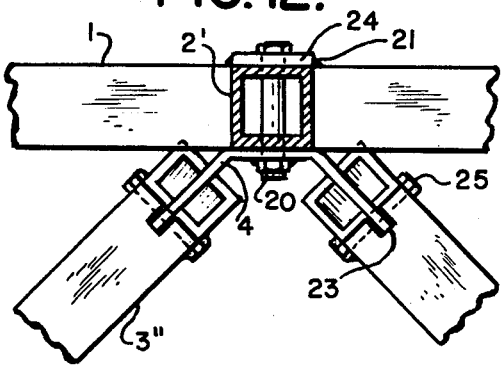
FIG. 12 is a fragmentary section from one side of the intersection shown in FIG. 11.
Figure 13:
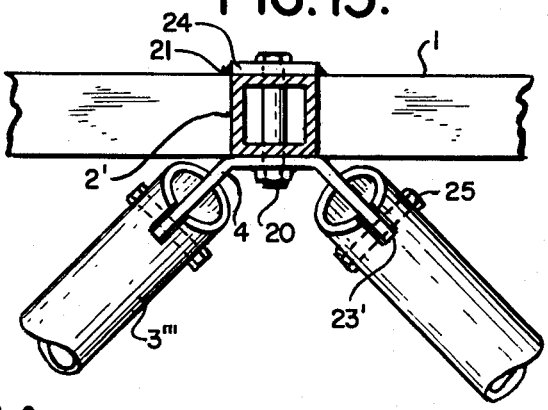
FIG. 13 is a fragmentary section from one side of an intersection in a system with end slotted diagonal struts made from round tubing.
Figure 14:
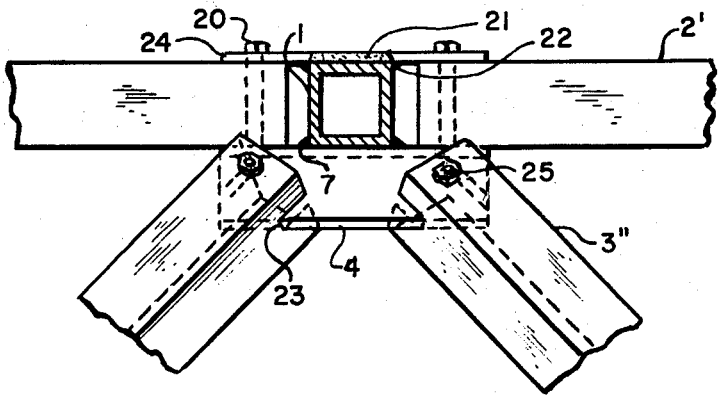
FIG. 14 is a fragmentary section from a second side of the intersection shown in FIG. 11.

Many of the advantages of this structure can be obtained, at lower cost, in the configuration shown in FIGS. 11, 12 and 14. There, double shear bolt loading and avoidance of eccentric loading are provided as to diagonal struts 3″ by providing slots 23 in the ends and bolting to connector plate 4 in a bite configuration using nut and bolt sets 25. A smaller, rectangular tie plate 24 is used, bolted to connector plate 4 through tie chords 2′ using nut and bolt sets 20. Plate 24 is welded to continuous chord 1 at weld 21, or alternately at weld 22, or by both, depending upon the strength required in the particular space frame. As also shown in FIG. 5, continuous chord 1 is welded by weld 7 to connector plate 4. By preforming the welds to continuous chord 1 at the factory, greater control of the welding is possible and there are fewer loose parts to be assembled on site. This is a preferred embodiment when the top surface does not need to be free and clear. Note as well, that because the continuous chord 1 is continuous, there is less need for it to be reinforced by a tie plate 14 as shown in FIGS. 8–10, tie plate 24 being sufficient. Round tubing, instead of square, may be used for diagonal struts of the slotted-end type, and these are shown as struts 3‴ in FIG. 13.

Figure 15:
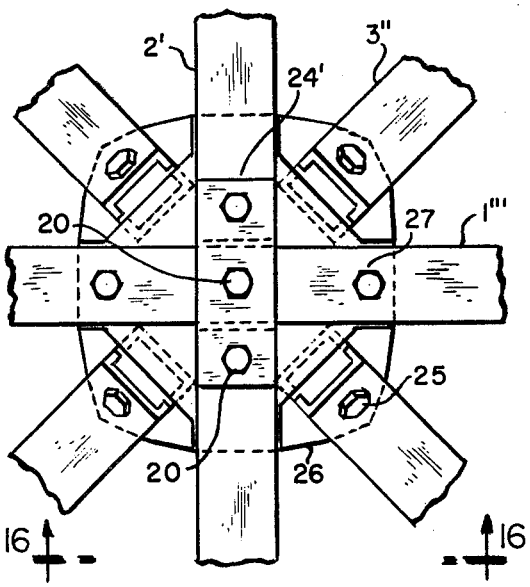
FIG. 15 is a fragmentary plan view showing one intersection with a four-tab connector plate, a rectangular tie plate, and end slotted diagonal struts.
Figure 17:
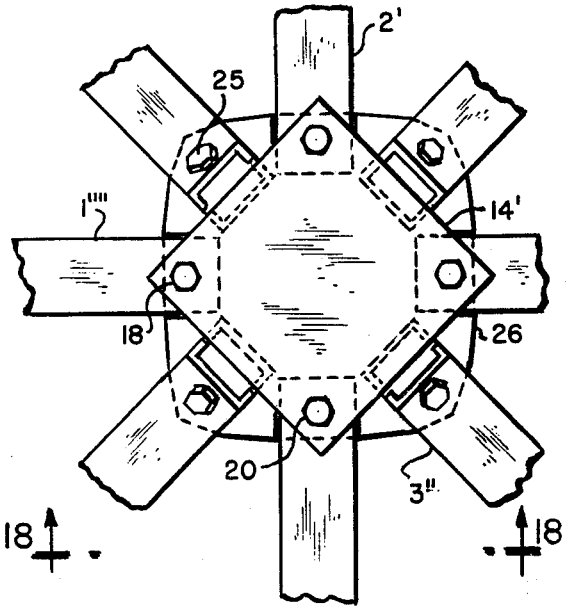
FIG. 17 is a fragmentary plan view showing one intersection with a square tie plate, a four-tab connector plate, and end slotted diagonal struts.
Figure 16:
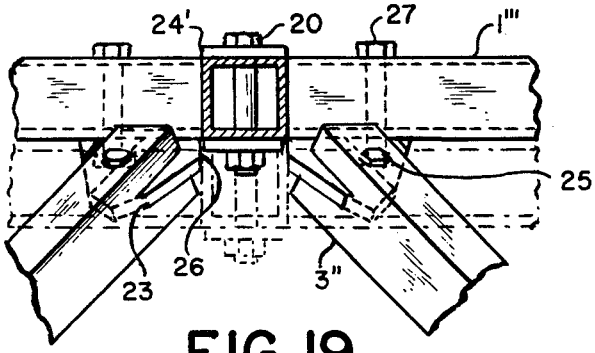
FIG. 16 is a fragmentary section from one side of the intersection shown in FIG. 15, in which an optional second set of chords is shown in dashed lines below the connector plate.
Figure 18:
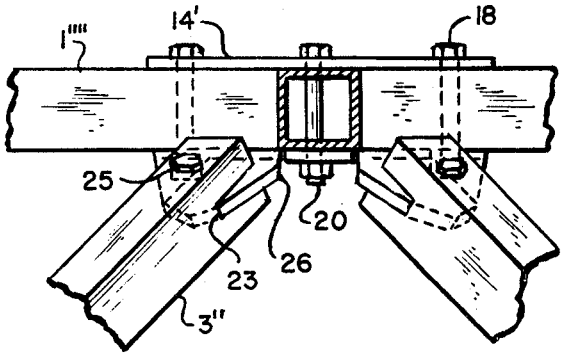
FIG. 18 is a fragmentary section from one side of the intersection shown in FIG. 17.

FIGS. 15 and 16 show an arrangement similar to that of FIGS. 11–14 but with no welding, continuous chord 1‴ being held by nut and bolt sets 20 and 27, and in place of connector plate 4, a four-tab connector plate 26 is used. The advantage of the four-tab plate 26 is that it is clear underneath for a second, mirror image set of tie chords 2′, continuous chords 1‴, and tie plate 24′, which may be used optionally for special requirements. This second set is shown by dashed lines in FIG. 16. A variation is shown in FIGS. 17 and 18 using a large square tie plate 14' in place of the rectangular tie plate shown in FIGS. 15 and 16.

Figure 19:
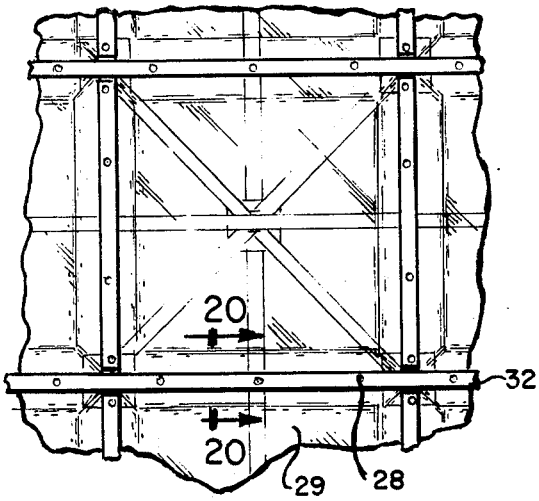
FIG. 19 is a fragmentary plan view showing one skylight mounted over one grid of a space frame system.
Figure 20:
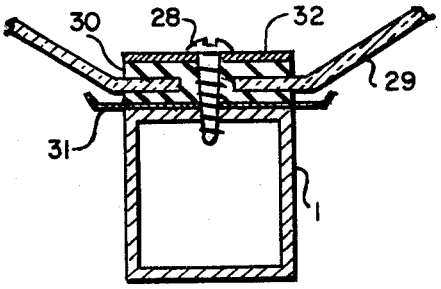
FIG. 20 is a fragmentary section of the skylight mounting structure on a chord.

When the top side walls of the chords are left free and clear, as in FIGS. 1–7, skylights or other panels can be sealingly mounted on a chord upper side wall as shown in FIG. 20. There the edge of skylight 29, made of a light transmitting material, is fitted into an elastomeric seal strip 30 made of neoprene, silicone rubber or similar material. This seal 30 may rest on an optional condensate drip strip 31 or directly upon chord 1 or 2. A rigid strip 32 of suitable metal or plastic holds seal 30 and self-tapping screws 28 are used to attach the assembly to the chord side wall. Other sealing mounts may be used, as appropriate to the particular design and application. The skylight panels may be fitted to cover one grid each as shown in FIG. 19, or long skylight panels may be used which rest along their long edges in seals as shown in FIG. 20, mounted only on chords running in one direction.

The various elements comprising the space frame system of the present invention may be formed of a variety of materials, either all of a single material, on any combination. Thus, the struts, chords and plates may be formed of a material selected from the group consisting of aluminum including aluminum alloys, steel and steel alloys including the stainless steels, plastics, fiber reinforced plastics including fiberglass containing plastics, wood and magnesium and magnesium alloys.

"Substantially parallel" as used herein to describe the spatial disposition of one of the chord frames of the inventive space frame system relative to the other chord frame includes such systems as those in which a roof is mounted directly upon the upper chord frame, with a slope to provide drainage, while the lower chord frame is horizontal.

Modifications of the standard, repeating intersection configuration are necessary at the frame boundaries for connection at edge support walls, for connection and mounting onto column supports, and the like. Where total spans exceed the length of tubing available for continuous chords, conventional joints may be made or joints may be accomplished within an intersection structure. While most attachments show the use of one nut and bolt set, it is expected that more than one nut and bolt set may sometimes be employed for additional strength and/or rigidity to meet unusual requirements. It is to be understood that the particular embodiments of the invention described and illustrated above are merely demonstrative of the principles thereof and numerous modifications and embodiments of the invention may be derived within the spirit and scope thereof.

What is claimed is:

1. In a plural grid modular space frame system of the type including at least two uniform dimensioned substantially rectangular grid planar chord frames held apart and substantially parallel by diagonal struts, one frame being out of registration with the other frame by one-half grid dimension in each substantially rectangular direction so that each chord intersection point on one frame is substantially apart from and opposite an open center of a grid rectangle of the other frame, each of said diagonal struts being one of a group of four struts extending from each said chord intersection point on one frame to each of the four nearest chord intersection points bounding said grid rectangular of the other frame to form a grid module, the improvement comprising:

a plurality of continuous chords;

a plurality of tie chords, said tie chords and said continuous chords being disposed in two substantially uniform dimensioned substantially rectangular grid planar chord frames, in each one of which all of said chords lie in a single plane for disposing any associated chord forces in said single plane, said continuous chords extending in one direction of said substantially rectangular grid with said tie chords extending in the other substantially rectangular direction at an angle to said one direction, each of said tie chords being a substantially discontinuous chord and extending one grid dimension from the intersection point with one of said continuous chords to the intersection point with the next continuous chord, said tie chords and said continuous chords being comprised of elongated hollow substantially rectangular tubes having four substantially flat side walls;

a plurality of diagonal struts, each extending from one of said chord intersection points on one of said chord frames to one of the four nearest chord intersection points on the other of said frames, said diagonal struts being elongated hollow tubes having side walls; and interconnection means for joining said continuous chords, said tie chords and said diagonal struts together at each of said intersection points, said interconnection means comprising threaded bolt means, threaded nut means threadably engageable with said threaded bolt means, and a plurality of bent plate connectors substantially uniformly modularly spaced apart along the longitudinal axis of each of said continuous chords throughout the length thereof and secured thereto at each of said interconnection points, each of said bent plate connectors being a substantially continuous member having a substantially straight portion secured to said continuous chord and a plurality of angulated portions extending therefrom to substantially define the planes of said diagonal struts in said space frame, said straight portion bearing against an external area of one of said flat side walls of each of said chords with said angulated portions being in load bearing relation with said struts, said bent plate connectors each having apertures through each of said portions within said load bearing area to receive said threaded bolt means, said continuous chords, said tie chords and said diagonal struts each having tube wall apertures, within said load bearing area alignable with said bent plate connector apertures for receiving said threaded bolt means disposed through said bent plate connector apertures, each of said threaded bolt means being disposed through said aligned bent plate connector and tube wall apertures and engaged with said threaded nut means so that each of said tie chords and diagonal struts is secured to said respective bent plate connector at each of said intersection points, said interconnection means further comprising means for fixedly securing each of said respective bent plate connector straight portions to said continuous chords at said intersection points, said continuous chords being concentrically loaded in said space frame and said substantially discontinuous tie chords being eccentrically loaded in said space frame, said continuous chords in said space frame having said bent plate connectors secured thereto being substantially stronger in compression and local bending than said substantially discontinuous tie chords in said space frame, said continuous chords being common for a plurality of said grid modules with said spaced apart bent plate connectors secured to each of said common continuous chords defining said intersection points for said plurality of grid modules, whereby enhanced strength in column activity and transverse bending for said modular space frame is provided.

2. An improved space frame system in accordance with claim 1 wherein said interconnection means further comprises a plurality of reinforcing flat tie plates with one of said reinforcing plates being disposed on the respective side of each of the chords opposite the respective bent plate connector where it is in contact with a plurality of chord side wall areas each of which is opposite one of said bearing areas for contacting and supporting each chord on the side wall opposite the side wall borne against by said respective bent plate connector, each of said reinforcing plates having an aperture therethrough in alignment with each said tube wall aperture in each said contacting chord side wall for receiving said threaded bolt means, said threaded bolt means being disposed through said reinforcing plate aperture, said opposing tube wall apertures in said chord and said bent plate connector, and engaged with said threaded nut means.

3. An improved space frame system in accordance with claim 2 in which said interconnection means further comprises reinforcing backup plates each one disposed on the sides of the diagonal struts opposite the respective bent plate connector and comprising a pair of angulated portions aligning with and contacting each diagonal strut side wall opposite one of said bearing areas proximate one of said intersection points, each said backup plate having a backup plate aperture through each of said angulated portions in alignment with each said tube wall aperture in each said contacting diagonal strut side wall for receiving said threaded bolt means, said threaded bolt means being disposed through said backup plate aperture, said opposing tube wall apertures in said diagonal strut, and said respective bent plate connector, and engaged with said threaded nut means.

4. An improved space frame system in accordance with claim 1 further comprising open ended slots in each of said diagonal struts disposed proximate said tube wall apertures, said slots being parallel to said elongated direction, said slots being dimensioned to fit over the edge of said angulated portions of said respective bent plate connector with said respective bent plate connector angulated portions being disposed within said respective slots, said threaded bolt means being disposed through one diagonal strut tube wall aperture, through said respective bent plate connector aperture, through the opposite diagonal strut tube wall aperture, and then engaged with said threaded nut means.

5. An improved space frame system in accordance with claim 6 wherein at least one of said end slotted diagonal struts comprises an elongated hollow round tube.

6. A space frame system in accordance with claim 1 wherein at least one of said plurality of diagonal struts has at least a different thickness for said side walls than another one of said plurality of diagonal struts, said thickness being at least dependent on the load to be carried by said diagonal strut, said one diagonal strut and said other diagonal strut at least carrying different loads.

7. A space frame system in accordance with claim 1 wherein at least one of said plurality of chords has at least a different thickness for said four flat side walls than another one of said plurality of chords, said thickness being at least dependent on the load to be carried by said chord, said one chord and said other chord at least carrying different loads.

8. A space frame system in accordance with claim 1 wherein at least one of said four flat side walls of at least one of said plurality of chords has at least a different thickness than another one of said four flat side walls, said thickness being at least dependent on the load to be carried by said one chord being such that said one flat side wall and said other flat side wall will be subjected to different stresses.

9. A space frame system in accordance with claim 1 wherein said chords, struts, plates, threaded bolts means, and threaded nut means each is formed from a material selected from the group consisting of aluminum, steel, plastics, fiber reinforced plastics, wood and magnesium.

10. An improved space frame system in accordance with claim 1, further comprising weld means for fixedly securing said threaded bolt means associated with said diagonal struts to the interior of said associated load bearing area with said bolt means extending outwardly therefrom through said apertures in said respective angulated portions for enabling said associated threaded nut means to be threadably engaged thereon to secure said diagonal struts to said angulated portions at said intersection points.

11. An improved space frame system in accordance with claim 1, further comprising weld means for fixedly securing said threaded bolt means associated with said tie chords to the interior of said associated load bearing area with said bolt means extending outwardly therefrom through said apertures in said respective straight portions for enabling said associated threaded nut means to be threadably engaged thereto to secure said tie chords to said straight portions at said intersection points.

12. An improved space frame system in accordance with claim 1, wherein each of said bent plate connectors comprises a single unitary piece.

13. An improved spaced frame system in accordance with claim 1, further comprising a skylight which transmits light and has parallel straight edges one distant from the other by one said rectangular grid dimension measured in the direction of said tie chords, said edges being so formed and disposed as to be able to rest in full contact with said side walls opposite said bent plate connectors of one of said continuous chords and the next continuous chord; and means for sealably mounting each said edge upon the side wall opposite said bent plate connectors of one of said continuous chords, so that said skylight may be sealably mounted to bridge from one of said continuous chords to the next with said skylight being integrated with the structure of said continuous chords.

14. An improved space frame system in accordance with claim 1, further comprising a skylight which transmits light and has four straight edges defining a rectangle of the same dimensions as one of said substantially rectangular grids, one of said side walls of said tie and continuous chords bounding said grid being substantially clear and free of projecting elements, said edges being so formed and disposed as to be able to rest in full contact with said clear and free side walls of said tie chords and continuous chords which bound said grid; and means for sealably mounting each said edge upon said clear and free side wall of the chord in said grid which corresponds to said edge, so that said skylight may be sealably mounted to cover said grid with said skylight being integrated with the structure of said chords bounding said grid.

15. An improved space frame system in accordance with claim 1, wherein said securing means comprises weld means.

16. An improved space frame system in accordance with claim 15 further comprising a skylight which transmits light and has parallel straight edges one distant from the other by one said rectangular grid dimension measured in the direction of said tie chords, said edges being so formed and disposed as to be able to rest in full contact with said side walls opposite said bent plate connectors of one of said continuous chords and the next continuous chord; and means for sealably mounting each said edge upon the side wall opposite said bent plate connectors of one of said continuous chords, so that said skylight may be sealably mounted to bridge from one of said continuous chords to the next with said skylight being integrated with the structure of said continuous chords.

17. An improved space frame system in accordance with claim 15, further comprising a skylight which transmits light and has four straight edges defining a rectangle of the same dimensions as one of said substantially rectangular grids, one of said side walls of said tie and continuous chords bounding said grid being substantially clear and free of projecting elements, said edges being so formed and disposed as to be able to rest in full contact with said clear and free side walls of said tie chords and continuous chords which bound said grid; and means for sealably mounting each said edge upon said clear and free side wall of the chord in said grid which corresponds to said edge, so that said skylight may be sealably mounted to cover said grid with said skylight being integrated with the structure of said chords bounding said grid.

18. An improved space frame system in accordance with claim 15, further comprising weld means for fixedly securing said threaded bolt means associated with said diagonal struts to the interior of said associated load bearing area with said bolt means extending outwardly therefrom through said apertures in said respective angulated portions for enabling said associated threaded nut means to be threadably engaged thereon to secure said diagonal struts to said angulated portions at said intersection points.

19. An improved space frame system in accordance with claim 18, further comprising weld means for fixedly securing said threaded bolt means associated with said tie chords to the interior of said associated load bearing area with said bolt means extending outwardly therefrom through said apertures in said respective straight portions for enabling said associated threaded nut means to be threadably engaged thereto to secure said tie chords to said straight portions at said intersection points.

20. An improved space frame system in accordance with claim 15, further comprising weld means for fixedly securing said threaded bolt means associated with said tie chords to the interior of said associated load bearing area with said bolt means extending outwardly therefrom through said apertures in said respective straight portions for enabling said associated threaded nut means to be threadably engaged thereto to secure said tie chords to said straight portions at said intersection points.

21. An improved space frame system in accordance with claim 15, wherein each of said bent plate connectors comprises a single unitary piece.

* * * * *